United States Patent [19]

Chierici

[11] 4,047,619

[45] Sept. 13, 1977

[54] UNCOUPLING DEVICE FOR ROTARY DUMP CARS

[75] Inventor: Osvaldo F. Chierici, Elmhurst, Ill.

[73] Assignee: Holland Company, Lombard, Ill.

[21] Appl. No.: 662,588

[22] Filed: Mar. 1, 1976

[51] Int. Cl.[2] ..... B61G 1/08; B61G 3/08

[52] U.S. Cl. ..... 213/166; 213/213; 213/218

[58] Field of Search ..... 213/141, 145, 162–166, 213/168–170, 159, 211, 213, 215, 218, 219

[56] References Cited

U.S. PATENT DOCUMENTS

| | | | |
|---|---|---|---|
| 458,998 | 9/1891 | Dose et al. | 213/219 X |
| 2,836,307 | 5/1958 | Wolfe | 213/166 X |
| 3,115,973 | 12/1963 | Kulieke | 213/169 X |
| 3,409,146 | 11/1968 | Taylor | 213/166 |
| 3,572,518 | 3/1971 | Wisler | 213/166 |
| 3,580,400 | 5/1971 | DePenti | 213/166 |
| 3,762,575 | 10/1973 | Cseri | 213/162 X |
| 3,937,330 | 2/1976 | McLean | 213/166 |

*Primary Examiner*—Drayton E. Hoffman
*Assistant Examiner*—Fred A. Silverberg
*Attorney, Agent, or Firm*—McWilliams & Mann

[57] ABSTRACT

An uncoupling device for rotary dump cars in which the car couplers are of the bottom operating type, wherein at each end of the car the uncoupling mechanism is made of the same type, and comprising both the rotary and non-rotary couplers of the car being equipped with paddle type lock lifters having a pivotal operating stroke that unlocks and opens the coupler knuckle, and a bail type actuator therefor, wherein the actuator comprises a bail member mounted on the end of the car to receive the car center sill and swing about a horizontal axis extending crosswise of the car and located at approximately the level of the top of the car center sill and inwardly of its striker. The bail member has a striker section that underlies the center sill and is equipped with a paddle striker that is arced to accommodate coupler side swing. The uncoupling device includes a handle structure journaled on the end of the car coaxially of the swing axis of the bail member and connected to the bail member to swing same to bring the bail member striker into striking engagement with the paddle, to thereby move the paddle through its full operating stroke to unlock and open the coupler knuckle. The bail member is spring-biased to a retracted position spaced from the paddle and disposed under the center sill striker.

9 Claims, 6 Drawing Figures

UNCOUPLING DEVICE FOR ROTARY DUMP CARS

This invention relates to an uncoupling arrangement for railroad cars of the rotary dump type, and more particularly, to an uncoupling arrangement or device for bottom operated rotary and non-rotary couplers, with which rotary dump cars are conventionally equipped.

Railroad cars of the rotary dump type, which are finding increasing use in the so-called unit trains, conventionally are arranged to permit the dumping of each car by the controlled tilting of same while the car is still connected in the train. For this purpose, cars of this type are equipped with a rotary coupler at the A end of the car, and a non-rotary coupler at the B end of the car, with both couplers usually being of the bottom operated type.

The rotary coupler at the A end of the car is conventionally equipped with an uncoupling device mounted on the car body but having no physical connection with the coupler head. A familiar form of uncoupling device of this type is the so-called bail type uncoupling rod assembly involving a bail member pivotally mounted on the car, usually on the end sill, and arranged to strike a paddle that is an integral part of the coupler lock lifter.

At the B end of the car, the coupler is equipped with an uncoupling device involving an operating rod that is physically connected to the coupler lock lifter.

Existing coupling arrangements of this type have presented a number of difficulties to the railroads. For instance, the operating lever or rod for the rotary coupler that operates the bail, and the bail itself, have a rather inefficient leverage relationship with respect to the coupler lock lifter that all too frequently results in the coupler unlocking mechanism being only partially operated, with consequent difficulty in uncoupling the car. The uncoupling rods for the coupler at the B end of the car have similar lever relationship efficiencies, and in addition, the coupler at the B end of the car is frequently arranged to be operated from either side of the car by equipping the coupler with a double eye lock lifter rotor, and uncoupling rodassemblies extending to either side of the car, which are frequently of right and left hand character; thus their parts cannot be made in duplicate, meaning that three separate types of uncoupling assemblies are required for such cars with corresponding complications in inventory requirements and attendant expense.

Another problem with conventional uncoupling arrangements for rotary dump cars is that the relatively low level of positioning of the operating rods employed creates interference problems with the car wheels and trainline connections, and also exposes the operating rods to damage when passed coupler impacts are occasioned.

A principal object of the present invention is to provide an uncoupling arrangement for rotary dump cars which insures that the coupler knuckle of the couplers at both ends of the car will both be unlocked and opened (and thus "popped") when the car is to be uncoupled.

Another principal object of the invention is to provide an uncoupling arrangement for rotary dump cars that permits the use of the same type of uncoupling device at both ends of the car.

Another important object of the invention is to arrange the uncoupling assembly at each end of the car to be free of interference with the car wheels and trainline connections, improve access to the trainline connections, and avoid the possibility of operating rod damage due to passed coupler impacts.

Still other objects of the invention are to provide an uncoupler arrangement for rotary dump cars that is inexpensive of manufacture, that is easy to install and service, that simplifies inventory requirements, and that is long lived in operation.

In accordance with the present invention, an uncoupling device is provided that may be applied to both ends of the rotary dump car, and comprises the coupler being equipped with a paddle type lock lifter having a pivotal operating stroke that both unlocks and fully opens the coupler knuckle, and a bail type actuator therefor, wherein the actuator comprises a bail member mounted on the end of the car to swing about a horizontal axis that extends crosswise of the car and is located at approximately the level of the top of the car center sill for increased operational leverage relationships with respect to the lock lifter. The bail member has a striker section equipped with a paddle striker that is arced to accommodate coupler side swing whereby the uncoupling device operates efficiently independent of the positioning of the coupler head sidewise of the car in the normal coupler side swing pattern. The uncoupling device includes a handle structure comprising an operating rod or lever journaled on the end of the car coaxially of the axis of swinging movement of the bail member, and connected to the bail member to swing the latter to bring its striker into striking engagement with the coupler paddle and move the coupler paddle through its full operating stroke. The bail member is spring biased to a retracted position spaced from the paddle and disposed under the center sill striker.

At the present time rotary couplers at the A end of the car are commonly equipped with a paddle type lock lifter with which the invention is adapted to cooperate. At the B end of the car, it is contemplated that the rotary lock lifter conventionally employed will be replaced by a paddle type lock lifter whereby the coupler carried uncoupling means will be functionally similar to that of the rotary coupler at the other end of the car. With this change, the B end of the car may be equipped with an uncoupling device of the present invention.

Where it is desired that, at either end of the car, the car be arranged to uncouple the car from either side of the car, the operating rod or lever of this invention is merely duplicated on either side of the car, with two sets of the operating rods being mounted to extend to the respective sides of the car, at each end of the car.

Other objects, uses, and advantages will be obvious or become apparent from a consideration of the following detailed description and the application drawings.

Figure 1:
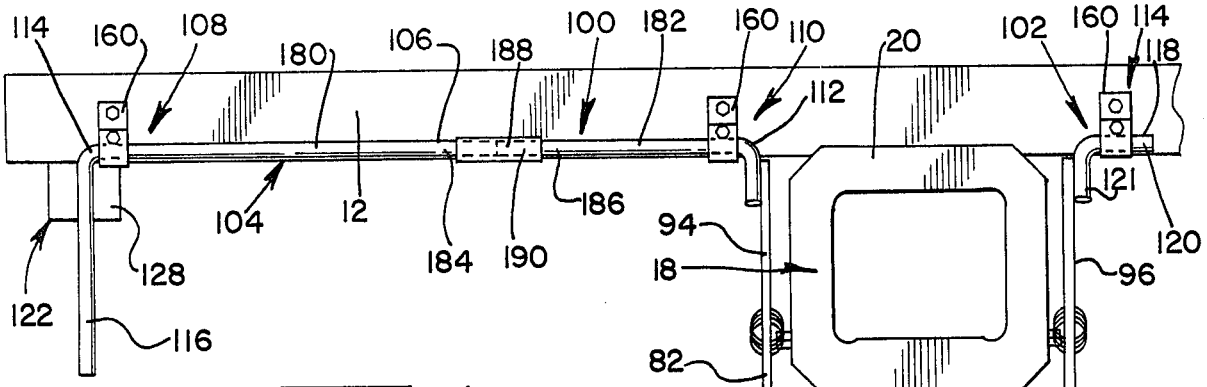
FIG. 1 is a fragmental end view of a railroad car equipped with a preferred embodiment of the invention.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 generally indicates a preferred embodiment of the invention applied to end sill 12 of the body of rotary dump car 14 that is equipped with the usual underframe 16 including conventional center sill 18 that protrudes from either end of the underframe 16 and is equipped with conventional coupler striker 20.

The coupler 22 is operably mounted in the center sill in any conventional manner, and in accordance with conventional practices, the coupler shank 24 is operably connected to the center sill and/or the body of car 14 through a conventional type of draft gear mechanism, an example of which is shown in U.S. Pat. No. 2,811,263, whereby the car is equipped for standard draft gear cushioning of coupler impacts applied to the coupler.

As is well known in the art, the body of car 14 is supported on the railroad track by suitable trucks (not shown), and the shank 24 of the coupler is secured to the car for swinging movement to either side of the car center line. In cars of the rotary dump type, the coupler at either end of the car conventionally has a 13° angle side swing capability to either side of the car center line.

The specific coupler 22 that is illustrated is intended to represent an AAR type F interlocking coupler comprising the coupler head 26 and the coupler shank 24. The coupler head 26 is provided on its upper side with the customary horn 28 having the usual rearwardly facing buffing surface 30 and abuts against the striker 20 to limit inward buffing movement of the car. Coupler 22 also has the usual knuckle 32 swingably mounted on the coupler head by pivot pin 34.

Figure 5:
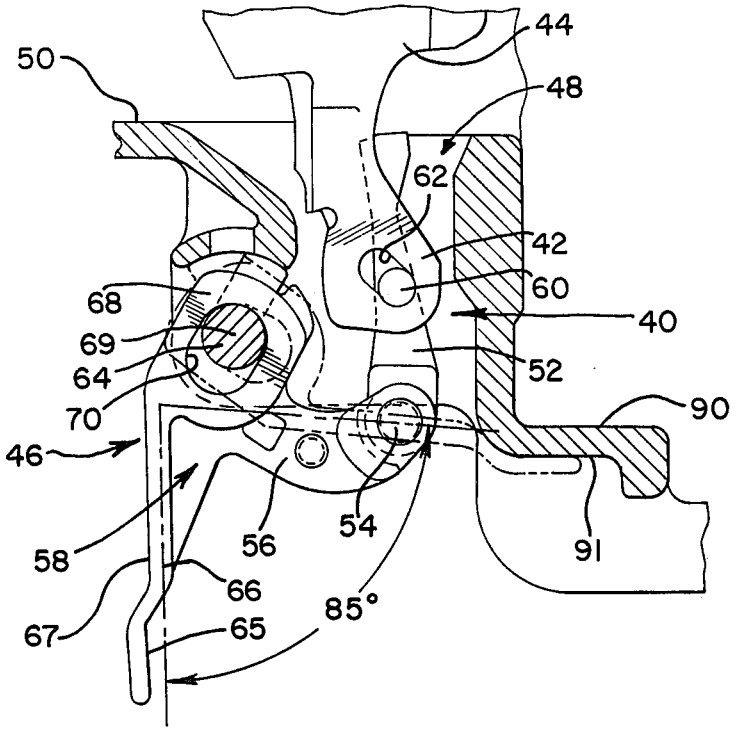
FIG. 5 is a fragmental sectional view taken substantially along line 5—5 of FIG. 2, with the coupler lock lift linkage shown in its normal rest position.

As indicated in FIG. 5, the coupler head is formed to define a passageway or chamber 40 in which is received the leg 42 of a conventional coupler lock 44 along with the lock lifter assembly 46. The passageway 40 communicates with the lock receiving cavity or opening 48 in the bottom wall 50 of the coupler head.

The lock lift assembly linkage 46 comprises the usual toggle 52 pivotally connected at its lower end by rivet 54 to the outer end of lock lift lever arm portion 56 of the lock lifter 58. The upper end of the toggle 52 is pivotally connected to the lower end of the lock leg 42 by means of a trunnion 60 on the toggle which is entered into and rides in an upwardly and rearwardly inclined slot 62 formed in the lower end of the lock leg 42.

The lock lifter 58 is rotably mounted on the coupler head on pivot pin 64 for rotation about a horizontal axis 69 and in a vertical plane paralleling the longitudinal center line of the coupler and within the passageway 40 between the spaced side walls defining same. The pivot pin 64 spans the passageway 40 and is suitably secured in place as by employing a cotter pin or the like.

Counterclockwise rotation of the lock lifter 58 about its pivot pin 64 (viewed as shown in FIG. 5) operates to swing the lock lifter arm 56 upwardly, thereby forcing the toggle 52 upwardly to first disengage from the conventional anti-creep shoulder on the tail of the knuckle 32 and then raise the lock 44 to cause it to pivot the usual knuckle throw arm (not shown) located within the hollow interior of the coupler head so as to effect full opening of the knuckle 32, all as is well known in the art.

In accordance with the present invention, the couplers at both the A and B end of the car are equipped with the lock lift assembly linkage 46, and the lock lifter 58 is of the type shown in U.S. Pat. No. 3,834,553, and thus includes operating arm 66, often referred to in the railroad field as the "paddle". The paddle 66 and lever arm 56 are substantially at right angles to each other and extend from the hub portion 68 of the lock lifter, which in the form shown has slot shaped opening or aperture 70 which receives the pivot pin 64 that pivotally mounts the lock lifter. In the normal rest position of the lock lifter 58, as indicated in the full line showings of FIGS. 3 and 5, the paddle or operating arm 66 extends vertically downwardly of the lock lifter hub portion 68 under the weight of the components of the linkage 46 that rest on lever arm 56.

Figure 3:
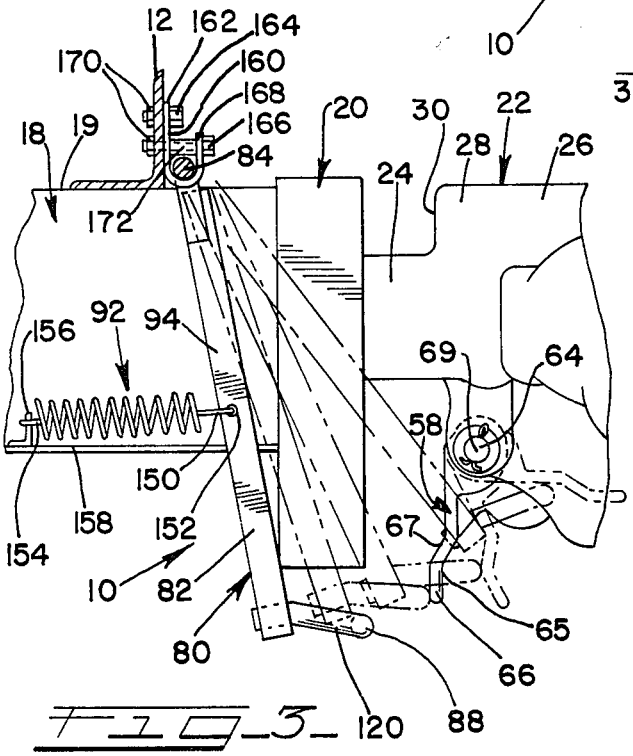
FIG. 3 is a side elevational view taken substantially along line 3—3 of FIG. 2, showing the bail member of the present invention in multiposition form, indicating its operational path of movement, and that of the coupler paddle, when the coupler is to be uncoupled.

While the rotary coupler of rotary dump cars are conventionally equipped with a paddle type lock lifter arrangement of the general type illustrated in FIGS. 3 and 5, the non-rotable coupler at the B end of the car ordinarily is not. In accordance with the invention, the conventional rotary lever of such couplers (which is located at the position of pivot pin 64) is removed and replaced by a lock lifter 58 having the aforementioned paddle 66.

Further in accordance with the invention, uncoupling device 10 comprises paddle actuator 80 comprising bail member 82 of U-shaped configuration disposed on either side of the center sill 18 and mounted for pivotal movement about a horizontal axis 84 extending transversely of the car and located approximately at the level of the top 19 of the center sill 18. Bail member 82 has a central striker portion 86 equipped with a paddle striker 88 of special configuration, and adapted to engage the paddle 66 to swing the lock lifter 58 between the normal riding position that is shown in full lines through the broken line positions of FIGS. 3 and 5 in which the coupler knuckle is both unlocked and swung to its fully opened position. As indicated in FIG. 5, this involves a swinging movement on the part of the lock lifter of 85°, at which point the lock lifter paddle engages the coupler safety support shelf 90.

The bail member 82 is biased to the full line retracted position of FIG. 3 by tension springs 92 acting between the bail member 82 and the center sill 18 on either side of the center sill.

Further in accordance with the invention, the bail member 82, which defines upwardly extending legs 94 and 96 that are integral with the striker section 86, is suspended by a handle structure 100 at one side thereof, and a trunnion structure 102 on the other side of same.

The handle structure 100 comprises operating rod or lever 104 having a rectilinear portion 106 journaled by bearing devices 108 and 110 to be in coaxial relation with the axis 84. The rod 104 has its inner end 112 disposed at right angles and affixed to the bail member leg 94 as by welding. The end 114 of the rod 104 is similarly angled and is extended to form hand grip portion 116 that is grasped by the operator to operate the device 10.

The trunnion structure 102 comprises rod member 118 of right angled configuration having one of its ends 120 journalled coaxially of the axis 84 by bearing device 114, and its other end 121 fixed to the bail member leg 96, as by welding.

Figure 2:
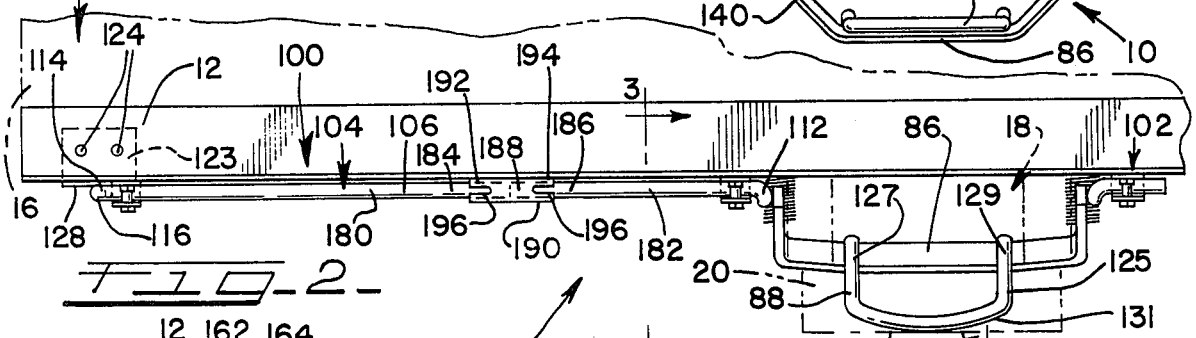
FIG. 2 is a top plan view of the structure shown in FIG. 1, with the coupler being shown.

Affixed to the car end sill 12 is the stop member 122 that is of right angle configuration defining a horizontally disposed flange 123 affixed to the underside of the end sill 112, as by employing rivets 124 or the like, and a vertically disposed flange 128 against which the operating rod hand grip portion 116 is biased by the action of the tension springs 92 to hold the device 10 in its retracted riding position of FIGS. 1 - 3.

As indicated, a device 10 is applied both to the A end and the B end of the car. Where the couplers involved are not equipped with the paddle type lock lifter that has been illustrated, the coupler is modified to be so equipped, in accordance with this invention, and of course this is simply done by removing the existing lock lifter and applying the commercially available paddle type lock lifter 58 in its place.

As indicated in FIG. 3, in the normal riding position of the device 10, the bail member 82 and its paddle striker 88 are disposed in spaced relation from the coupler paddle 66. The uncoupling device therefore is physically separated from the coupler lock lifter 58 and rotates with the car body and underframe when the car is tilted for dumping same.

Where the car is to be uncoupled, the operator grasps the operating rod or lever hand grip portion 116 and swings same counterclockwise of FIG. 3, whereby the bail member striker 88 is swung against the coupler paddle rearward surface 67.

In accordance with the invention, the location of the axis 84 about which the bail member 82 acts is such that the paddle striker 88 acts on the paddle through actuation of the hand grip portion 116 with a lever advantage on the order of two to one. Furthermore, the positioning of the paddle striker 88 against the paddle rearward surface 67 during the movement of the lock lifter 58 through its operating stroke is such that a lever arm of at least approximately five inches is present between the pivot axis 69 of the lock lever and the point of engagement of the paddle striker 88 with the paddle 66, at any point in such stroke.

The paddle striker 88 is also oriented relative to the bail member 82 such that when it engages the paddle 66, it is substantially horizontally disposed, and has a slightly angled upwardly inclined relation when the lock lifter uncoupling stroke is completed with the forwardly facing side 65 of the paddle flush against the coupler shelf undersurface 91.

SPECIFIC DESCRIPTION

The bail member 82 in accordance with the invention is preferably formed from bar stock having a rectangular transverse cross-sectional configuration, with the U configuration form such that the long dimension of the indicated transverse cross-sectional configuration is perpendicular to the plane of the member 82. This arrangement provides a rigidity factor in the bail member that resists bending forces involved as a result of the improved leverage that the operator in moving handle 116 acts through the bail member when he operates the lock lifter 48 to uncouple the coupler in accordance with the invention.

The bail member striker 88 is formed from round bar stock to define U-shaped member 15 having legs 125 and 127 that are fixed to the bight portion 86 of the bail member 82, which legs merge into bight portion 131 that is of rounded configuration (see FIG. 2) in conformance with the side swing of the coupler to either side of the center line of the car, which in practice is thirteen degrees. The bight portion 131 of the striker 88 thus should be struck on an arc centered at the point of pivotal swing of the coupler 22.

Figure 6:
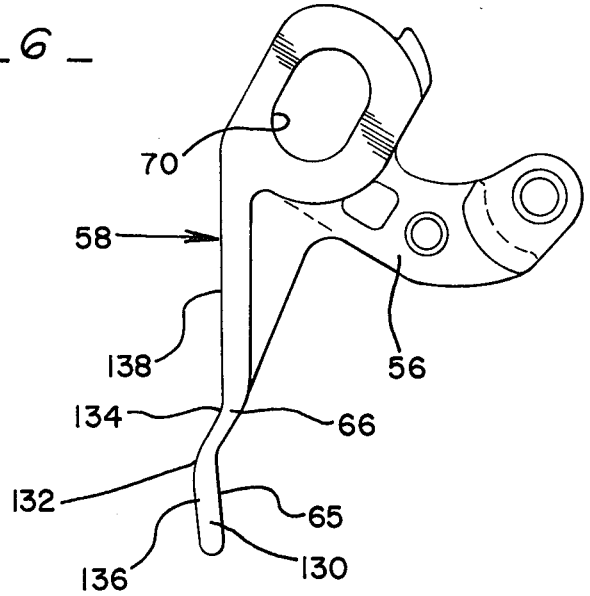
FIG. 6 is a plan view of the paddle equipped lock lifter that is employed in connection with the present invention.

Thus, regardless of the position of the coupler relative to the striker 88, when the striker 88 contacts the paddle surface 67, the contacting portion of the striker 88 will be tangent to the paddle surface 67,

As already indicated, the coupler components shown in FIGS. 5 and 6 are commercially available and in the specific lock lifter 58 that is shown, the lower end 130 of the paddle 66 is offset rearwardly of the lock lifter 58 to define a convexly curved portion 132 that merges into a concavely curved portion 134. The portions 136 and 138 of the paddle surface are essentially planar. As indicated in FIG. 3, when the striker 88 initially engages the paddle 66, it is the lower portion of the surface 136 that is contacted, and at the completion of the working stroke of the bail member 82, the striker 88 is closely adjacent the convexly curved portion 134 in the area of the surface 138.

The striker section 86 of bail member 82 is of rectilinear configuration and has on either side of same diagonal portions 140 and 142 between which the striker member 88 is applied. This facilitates location of the striker member 88 with respect to the bail member 82.

Tension springs 92 in the form shown are of the helical type having one end 150 hooked for application to a hole 152 formed in the bail member 82 for that purpose, and having the other end 154 hooked for application to a similar hole formed in angle bracket 156 that is suitably affixed to the center sill flange 158. This construction is the same on either side of the center sill.

The bearing devices 108, 110 and 114 each comprise a bracket 160 of J configuration having the longer leg 162 fixed to the car end sill 12 by a first bolt 164, with a second bolt 166 of longer length extending through the shorter leg 168 as well as the longer leg 162 and the end sill 12; nuts 170 are employed to secure both the bolts 164 and 168 in place. The longer bolt 166 also mounts a hold down sleeve 172 that maintains the underlying portions of the operating rod 100 in alignment with the pivotal axis 84; in the case of bearing device 114, it is the rod end 120 that is so held.

The operating rod or lever 100 is formed from round bar stock, as is the mounting segment 102. In the illustrated embodiments, the rectilinear portion 106 involves the rod 100 being in two sections 180 and 182 having their adjacent ends 184 and 186 fixed together by being received within tubular coupling 188. This arrangement accommodates on the site adjustment of the particular device 10 for a particular car whereby the coupling 188 may be fixed to one of the sections 180 or 182, and the other section cut to fit depending on the desired location of the angle bracket 128 and the bailer member 182 relative to the end of the car and the car center sill 18.

In the specific form shown, the coupling 188 is a sleeve 190 having its ends 192 and 194 slotted as at 196, at 180 degree locations, to receive welding material when the indicated ends 184 and 186 are inserted into the sleeve 190 in the final application of the device to the car.

Figure 4:
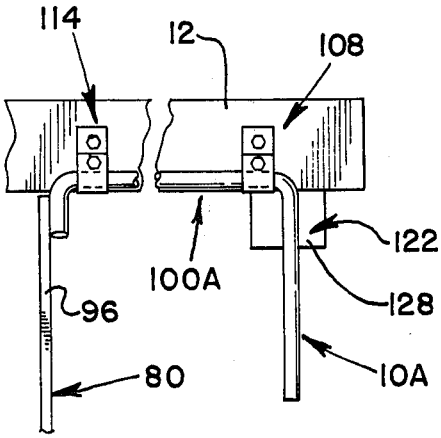
FIG. 4 is a fragemental view similar to that of FIG. 1, but showing the right hand side of the car, and illustrating a modified form of the invention.

In the modification of FIG. 4, the device 10A involves a second operating rod 100A, which is the same as operating rod 100, applied to the other side of the car end in the same manner as the operating rod 100 is applied. This involves elimination of the mounting section 118 and the application to the car end sill on that side of the car of a second bearing unit 108. The operating rods 100 and 100A are identical in construction and may be used interchangeably. A second stop member 122, mounted in the same manner as that shown in FIGS. 1 and 2, is provided for cooperation with rod 100A. The device 10A is otherwise the same as device 10.

The arrangement of FIG. 4 permits a particular bail member 82 to be operated from either side of the car.

The length of the bail member 82 and its angulation with respect to the center sill, for any particular installation, will depend on the amount that the car center sill, and specifically the striker 20, extends from the car body. In accordance with the invention, the bail member is secured to the car body, and conveniently, to the car body end sill, and the riding position of the bail member should dispose the bail member striker substantially in the position shown in FIG. 3 relative to the striker 20. As it is desired that the bail member striker 88 be substantially horizontally disposed when it initially strikes the paddle 66, the striker 88 ordinarily will be angled somewhat with respect to the plane of the bail member, as indicated in FIG. 3. One of the advantages of the coupling 188 is that the handle section 180 can be applied to same, for a particular installation, after the correct angulation of the bail member to produce the general arrangement indicated in FIG. 3, has been determined.

It will therefore be seen that the invention provides an uncoupling arrangement for rotary dump cars which not only insures that the coupler knuckle will be fully opened on each operation of the uncoupling device, but also permits the use of the same type of uncoupling device at each end of the car. Since in such arrangements the uncoupling device operating rod or lever will be physically separated from the coupler paddle at both ends of the car, there is no need to be concerned about which end of the car is connected to the rotary coupler of an adjacent car. Rotary dump cars conventionally equipped with the familiar rotary coupler lock lifter frequently have the operating rod physically disconnected from the lock lifter during the dumping procedures, and while the car remains in unit train service no particular problems are involved if the re-connection is not made. However, the re-connection must be effected before the car goes back into interchange service and this is fraquently overlooked with consequent violation of AAR regulations on the subject.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a railroad car having a body including a center sill projecting from one end of the car and equipped with a coupler striker and a bottom operating coupler mounted on the center sill, with the coupler being mounted for swinging movement sidewise of the car and including a pivotal lock lifter having a depending paddle for actuating the lock lifter to uncouple the coupler, with the lock lifter having a pivotal operating stroke to uncouple the coupler, and with the car having an uncoupling lever device at said end thereof, said device including an actuator pivotally mounted on the car and having a striker section underlying the center sill and positioned to be swung from under the center sill to strike the paddle to actuate the lock lifter, said center sill striker being disposed in a vertical plane and spaced outwardly of the car body end at said end of said car, longitudinally of said car, and including a handle structure operatively secured to the actuator for pivoting the actuator to strike the paddle and pivot the lock lifter about its operating stroke, and means for spring biasing the actuator to a retracted position in which said striker section thereof is disposed in a retracted position under the center sill and spaced from the paddle, the improvement wherein:

the actuator is mounted on said end of the car body for making said pivotal movement about a horizontal axis that is disposed at a level approximating that of the top of the center sill, with said horizontal axis being disposed between said car body end and the center sill striker and spaced inwardly of the car from the center sill striker longitudinally of the car and adjacent said body end, said horizontal axis extending transversely of the car, said handle structure comprising an operating rod portion journaled on the car in coaxial relation to said horizontal axis and a handle for pivoting said operating rod portion about said axis to pivot said actuator about said axis for striking the paddle for pivoting same about its operating stroke, said actuator being proportioned radially of said axis to dispose said striker section thereof in substantial alignment with the plane of the center sill striker when said actuator is in its retracted position, said actuator and said handle structure operating rod portion being free of securement to the center sill striker, whereby both said actuator and said handle structure operate about said horizontal axis and said actuator striker section acts on the paddle with the leverage measured by the spacing of same radially of said horizontal axis, wherein the car body has a body end sill at said end thereof and said actuator and handle structure are mounted on said end sill, wherein said actuator striker includes a paddle striker, said paddle striker comprising a striker element fixed to said actuator striker section and projecting forwardly in the direction of the coupler paddle, said striker element along its forward edge being convexly curved to either side of the car in substantial conformance with the range of coupler swinging movement sidewise of the car for effecting said lock lifter pivotal operating stroke on striking same, under the operation of said handle structure, with the coupler positioned within said side swing.

2. The improvement set forth in claim 1 wherein:

said actuator comprises a bail member of substantially U-configuration defining a pair of legs separated by a bight portion that comprises said striker section, said handle structure being secured to said bail member at one of said legs thereof.

3. The improvement set forth in claim 2 wherein:

said handle structure operating rod portion includes a rectilinear portion journalled on said car body end on one side of the center sill to pivotally mount said bail member one leg for said actuator pivotal movement, with said bail member one leg being on said one side of the center sill and said bail member other leg being on the other side of said center sill, said bail member other leg being journalled on said car body end to pivotally mount said bail member other leg for said pivotal movement of said bail member.

4. The improvement set forth in claim 3 including:

a second handle structure mounted on the other side of the center sill that is operatively secured to the actuator for pivoting the actuator to strike the paddle for effecting the lock lifter operating stroke, said second handle structure including a rectilinear portion journalled on said car body end on said other side of said center sill and secured to said actuator for swinging said striker section about said horizontal axis, said second handle structure being journalled coaxially of said axis and including a depending handle disposed adjacent the other side of the car end.

5. The improvement set forth in claim 2 wherein:

said bail member legs are disposed on either side of the center sill, and including means for journalling said bail member legs on said car body end for said pivotal movement of said actuator.

6. The improvement set forth in claim 2 wherein:

said bail member is formed from bar stock of rectangular transverse cross-sectional configuration with said legs and bight portion thereof disposed, and with the long dimension of said bar stock cross section configuration being disposed normally of the plane of said bail member.

7. The improvement set forth in claim 1 wherein:

said striker element is disposed relative to said center sill to dispose said striker element substantially horizontally when said actuator has been moved about said axis to abut said striker element against the paddle.

8. The improvement set forth in claim 1 including:

a stop fixed to the car body at said end thereof and limiting movement of said actuator toward said car body under said biasing means to dispose said actuator in said retracted position thereof free of engagement with the center sill.

9. The improvement set forth in claim 1 wherein:

the lock lifter operating stroke is approximately 85° in which the paddle moves forwardly of the car from a substantially vertically disposed position to a substantially horizontal position in which the coupler has been opened, said axis and said actuator striker section being located relative to the coupler and said handle such that said actuator acts on said paddle upon movement of said handle to effect said lock lifter stroke with a predetermined lever advantage.

* * * * *

UNITED STATES PATENT OFFICE

CERTIFICATE OF CORRECTION

Patent No. 4,047,619 Dated September 13, 1977

Inventor(s) OSVALDO F. CHIERICI

It is certified that error appears in the above-identified patent and that said Letters Patent are hereby corrected as shown below:

Column 6, line 4, "15" should be --125--; Column 8, lines 46 & 47, delete --radially of said horizontal axis--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*